US007368877B2

(12) United States Patent
Hayafuji

(10) Patent No.: US 7,368,877 B2
(45) Date of Patent: May 6, 2008

(54) LIGHT EMITTING DISPLAY DEVICE AND DRIVE CONTROL METHOD THEREOF

(75) Inventor: Akinori Hayafuji, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 87 days.

(21) Appl. No.: 11/114,122

(22) Filed: Apr. 26, 2005

(65) Prior Publication Data

US 2005/0237001 A1 Oct. 27, 2005

(30) Foreign Application Priority Data

Apr. 27, 2004 (JP) ..... 2004-130680

(51) Int. Cl.
*G09G 3/10* (2006.01)

(52) U.S. Cl. ..... 315/169.2; 315/169.1; 315/169.3; 315/312

(58) Field of Classification Search ..... 315/169.2, 315/169.3, 169.1, 312; 345/211, 76–85, 345/204

See application file for complete search history.

(56) References Cited

U.S. PATENT DOCUMENTS 5,172,108 A * 12/1992 Wakabayashi et al. ..... 345/691
6,858,992 B2 * 2/2005 Park et al. ..... 315/169.3
6,894,436 B2 * 5/2005 Togashi et al. ..... 315/169.4
7,023,415 B2 * 4/2006 Fujita et al. ..... 345/98
7,042,164 B2 * 5/2006 Yazawa ..... 315/169.3
7,084,848 B2 * 8/2006 Senda et al. ..... 345/92
7,088,319 B2 * 8/2006 Yoshida et al. ..... 345/82
7,119,768 B2 * 10/2006 Yazawa et al. ..... 345/76
2004/0252087 A1 * 12/2004 Yazawa ..... 345/76
2005/0012698 A1 * 1/2005 Takahashi ..... 345/77
2005/0067553 A1 * 3/2005 Agari et al. ..... 250/205
2005/0179627 A1 * 8/2005 Hayafuji et al. ..... 345/76

FOREIGN PATENT DOCUMENTS

JP 2002-366101 12/2002
JP 2003-316315 11/2003

* cited by examiner

*Primary Examiner*—Douglas W. Owens
*Assistant Examiner*—Chuc Tran
(74) *Attorney, Agent, or Firm*—Westerman, Hattori, Daniels & Adrian, LLP.

(57) ABSTRACT

A clock signal synchronized with a data write signal for each scan line supplied from a light emission control circuit 4 to a scan driver 6 is supplied to an oscillator 12 generating a reference switching signal of a DC-DC converter 8 by a PWM method via a frequency divider 14. Thus, even when a ripple component by a switching operation of the converter has been superimposed on a drive voltage Va, constantly the same gate-to-source voltage Vgs is supplied to a light emission drive transistor Tr2 for each scan line, whereby a problem that a state in which light emission intensities differ for each scan line is brought about can be resolved. Further, the duty ratio of a switching signal from a PWM circuit 11 is detected by a detection circuit 13 to grasp the load condition of the converter, and when the load is light, the division ratio of the frequency divider 14 is increased to execute the switching operation at a low frequency. In this manner, the cycle (boost cycle) of the switching operation in the converter is made greater, so that a useless power loss by the switching operation in the converter can be reduced, whereby the power utilization rate of a light load time can be improved.

15 Claims, 8 Drawing Sheets

LIGHT EMITTING DISPLAY DEVICE AND DRIVE CONTROL METHOD THEREOF

BACKGROUND OF THE INVENTION

1. Field of the Invention

The present invention relates to a light emitting display device equipped with a display panel in which light emitting elements constituting pixels are actively driven for example by TFTs (thin film transistors), and to a light emitting display device and a drive control method thereof by which the display quality of an image can be effectively prevented from being deteriorated by a ripple component superimposed for example on a drive source of the display panel.

2. Description of the Related Art

A light emitting display device employing a display panel constituted by arranging light emitting elements in a matrix pattern has been developed widely, and as a light emitting element employed in such a display panel, for example an organic EL (electroluminescent) element in which an organic material is employed in a light emitting layer has attracted attention. This is because of backgrounds one of which is that by employing, in the light emitting layer of the EL element, an organic compound which enables an excellent light emission characteristic to be expected, a high efficiency and a long life which are sustainable for practical use have been advanced.

As a display panel employing such organic EL elements, a simple matrix type display panel in which EL elements are simply arranged in a matrix pattern and an active matrix type display panel in which respective active elements constituted by the above-mentioned TFTs are added to respective EL elements arranged in a matrix pattern have been proposed. The latter active matrix type display panel can realize low power consumption compared to the former simple matrix type display panel and has a characteristic that crosstalk among pixels is small and the like, whereby it is particularly suitable for a high definition display constituting a large screen.

FIG. 1 shows one example of a light emitting display device equipped with a basic circuit structure corresponding to one pixel in a conventional active matrix type display panel, its drive circuit, and a power source circuit supplying a drive power source to a display panel equipped with a large number of the pixels. In the display panel 1, a circuit structure of one pixel 2 is shown for convenience of illustration, and the circuit structure of this pixel 2 shows a most basic pixel structure of a case where an organic EL element is employed as a light emitting element, that is, a case of a so-called conductance controlled method.

That is, a gate electrode (hereinafter simply referred to as a gate) of an N-channel type scan selection transistor Tr1 constituted by a TFT is connected to a scan line (scan line A1), and a source electrode (hereinafter simply referred to as a source) is connected to a data line (data line B1). A drain electrode (hereinafter simply referred to as a drain) of this scan selection transistor Tr1 is connected to a gate of a P-channel type light emission drive transistor Tr2 and to one terminal of a charge-retaining capacitor Cs.

A source of the light emission drive transistor Tr2 is connected to the other terminal of the capacitor Cs and receives supply of a drive power source Va (hereinafter referred to also as a drive voltage Va) from a later-described DC-DC converter via an power source line P1 arranged in the display panel 1. A drain of the light emission drive transistor Tr2 is connected to an anode terminal of an organic EL element E1, and a cathode terminal of this organic EL element E1 is connected to a reference potential point (ground) in the example shown in FIG. 1.

In the circuit structure of the pixel 2, when a selection voltage Select is supplied to the gate of the scan selection transistor Tr1 via the scan line A1 during an address period (data write period), the scan selection transistor Tr1 becomes in an ON state. Upon receiving a data voltage Vdata which corresponds to write data supplied from the data line B1 to the source of the scan selection transistor Tr1, the scan selection transistor Tr1 allows current corresponding to the data voltage Vdata to flow from the source to the drain. Therefore, during a period in which the selection voltage Select is applied to the gate of the transistor Tr1, the capacitor Cs is charged, and the charge voltage becomes one corresponding to the data voltage Vdata.

Meanwhile, the charge voltage charged in the capacitor Cs is supplied to the light emission drive transistor Tr2 as a gate voltage, and current based on the gate voltage of the light emission drive transistor Tr2 and the drive voltage Va supplied via the power source line P1 that is the source voltage flow from the drain thereof to the EL element E1, and the EL element E1 is driven to be lit by the drain current of the light emission drive transistor Tr2.

Here, an addressing operation corresponding to one scan line is completed, and when the gate potential of the scan selection transistor Tr1 becomes an OFF voltage, this transistor Tr1 becomes a so-called cutoff while the drain side of the transistor Tr1 becomes in an open state. However, the gate voltage of the light emission drive transistor Tr2 is maintained by electrical charges accumulated in the capacitor Cs, the same drive current is maintained until the data voltage Vdata is rewritten during a next address period, and a light emission state of the EL element E1 based on this drive current is also continued.

A large number of the structures of the pixel 2 described above are arranged in a matrix pattern in the display panel 1 shown in FIG. 1 to constitute a dot matrix type display panel, and respective pixels 2 are formed at intersection positions between respective scan lines A1, . . . and respective data lines B1, . . .

A video signal to be displayed on the light emission display panel 2 is supplied to a light emission control circuit 4 shown in FIG. 1. In this light emission control circuit 4, based on horizontal and vertical synchronization signals in the video signal, sampling process and the like is imparted to an inputted video signal so that the signal is converted to corresponding pixel data for each pixel, and an operation of writing the converted pixel data in an unillustrated frame memory one by one is executed. During an address period after a writing process of pixel data of one frame in the frame memory is completed, the serial pixel data read out of the frame memory for each one scan line and a shift clock signal are supplied to a shift register and data latch circuit 5*a* in a data driver 5 one by one.

In this shift register and data latch circuit 5*a*, pixel data corresponding to one horizontal scan is fetched to be latched utilizing the shift clock signal, so that a latch output corresponding to one horizontal scan is supplied to a level shifter 5*b* as parallel data. By this operation, the data voltage Vdata corresponding to the pixel data is individually supplied to the source of the scan selection transistor Tr1 constituting each pixel 2. Such an operation is repeated for each one scan during the address period.

A scan shift clock signal corresponding to the horizontal synchronization signal is supplied from the light emission control circuit 4 to a scan driver 6 during the address period. This scan shift clock signal is supplied to a shift register 6*a* to generate a register output one by one. The register output is converted to a predetermined operational level by a level shifter 6*b* to be outputted to the respective scan lines A1, . . . By this operation, the selection voltage Select is supplied to the gate of the scan selection transistor Tr1 constituting each pixel 2 for each scan line one by one.

Therefore, the respective pixels 2 arranged on a scan line on the display panel 1 receive a supply of the selection voltage Select from the scan driver 6 for each one scan of the address period. In synchronization with this, the data voltage Vdata is supplied from the level shifter 5*b* in the data driver 5 to the respective pixels 2 arranged for each scan line, and the gate voltage corresponding to the data voltage Vdata is respectively written in the capacitor Cs in each pixel corresponding to this scan line. By allowing this operation to be implemented covering all scan lines, an image corresponding to one frame is reproduced on the display panel 1.

Meanwhile, the drive voltage Va by a DC-DC converter designated by reference numeral 8 is supplied to the respective pixels 2 arranged on the display panel 1 via the power source lines P1, . . . In the structure shown in this FIG. 1, the DC-DC converter 8 utilizes PWM (pulse width modulation) control so as to boost the output of a primary side DC voltage source Ba.

This DC-DC converter 8 is constructed so as to allow a MOS type power FET Q1 as a switching element to be controlled to be turned on at a predetermined duty cycle by a PWM wave outputted from a switching regulator circuit 9. That is, electrical energy from the primary side DC voltage source Ba is accumulated in an inductor L1 by the ON operation of the power FET Q1, and electrical energy accumulated in the inductor L1 is accumulated in a smoothing capacitor C1 via a diode D1 accompanied by an OFF operation of the power FET Q1. By allowing the power FET Q1 to repeat on-off operations, a boosted DC output can be obtained as a terminal voltage of a capacitor C1.

The DC output voltage is divided by a thermistor TH1 performing temperature compensation and resistors R11 and R12 to be supplied to an error amplifier 10 in the switching regulator circuit 9. In this error amplifier 10, the above-mentioned divided output is compared to a reference voltage Vref, and its comparison output (error output) is supplied to the PWM circuit 11. In this PWM circuit 11, a chopping wave for PWM is generated based on an oscillation signal provided from an oscillator 12 to generate a PWM wave based on this chopping wave and the comparison output. By this PWM wave, a switching operation of the power FET Q1 is performed, and feedback control is performed to hold the output voltage at a predetermined drive voltage Va. Therefore, the output voltage by the DC-DC converter, that is, the drive voltage Va, can be described by the following equation 1:

$$Va = V\mathrm{ref} \times [(TH1 + R11 + R12)/R12] \quad \text{(equation 1)}$$

A pixel structure and a structure of a drive circuit thereof as shown in FIG. 1 are disclosed in Japanese Patent Application Laid-Open No. 2003-316315 which has been already filed by the present applicant, and a DC-DC converter as shown in FIG. 1 is also disclosed in Japanese Patent Application Laid-Open No. 2002-366101 which has been already filed by the present applicant.

Meanwhile, in the structure of the pixel 2 shown in FIG. 1, the drain current Id by which the organic EL element E1 is driven to emit light is determined by the difference (gate-to-source voltage=Vgs of the transistor Tr2) between the drive voltage Va supplied via the power source line P1 and the gate voltage of the drive transistor Tr2 determined by electrical charges accumulated in the capacitor Cs. FIG. 2 shows an equivalent circuit of the pixel structure, and the already described scan selection transistor Tr1 is replaced and represented by a switch SW1. In FIG. 2, the data voltage Vdata transmitted via the data line B1 is equivalently designated by a gate voltage Vgate by a variable voltage source.

Here, for the drive voltage Va supplied to the source of the transistor Tr2, a boosted voltage by the DC-DC converter is employed as already described, and in this type of DC-DC converter, it cannot be avoided that some degree of ripple noise (ripple component) is superimposed on the voltage Va, since the switching operation is accompanied on the operating principle thereof. In the DC-DC converter, although the level of the ripple component can be decreased more when a large capacity smoothing capacitor C1 is employed, decrease effect for the ripple component cannot be expected so much compared to the ratio at which the capacitance thereof is increased.

Particularly, although the demand for the display panel and the DC-DC converter driving this display panel which are shown in FIG. 1 is increasing due to the spread of cellular phones, personal digital assistants (PDAS), and the like, employing a large capacity smoothing capacitor for this type of equipment not only increases the cost but also increases the occupying volume of the capacitor. Thus, restriction on design that the capacitance of the smoothing capacitor has to be restrained to some degree exists as a reality.

Therefore, in the equivalent circuit shown in FIG. 2, the drive voltage on which the ripple component corresponding to a switching cycle (voltage boost cycle Si) of the DC-DC converter is superimposed is supplied to the source of the light emission drive transistor Tr2 as shown as Va in FIG. 3. Meanwhile, the switch SW1 is turned on at an addressing time (data write time), and the gate voltage Vgate based on the video signal is supplied to the gate of the drive transistor Tr2.

Here, Ls in FIG. 3 denotes one scan (line) period in the display panel, and Fs represents one frame period. Since the switching operation in the DC-DC converter is independently activated having nothing to do with one scan period in the display panel, write voltages whose gate-to-source voltages Vgs are different for each scan line influenced by the ripple component are written in the capacitors Cs of the respective pixels.

That is, as shown in FIG. 3, for example, in the capacitors Cs of the respective pixels corresponding to a first scan line, data based on a gate-to-source voltage shown as Vgs1 is written, and in the capacitors Cs corresponding to a second scan line and a third scan line, data based on gate-to-source voltages shown as Vgs2, Vgs3 are written, respectively.

FIG. 4 shows a Vgs/Id characteristic (gate-to-source voltage vs. drain current characteristic) of a TFT represented by the transistor Tr2, and in the case where the gate-to-source voltage changes in the range of ΔVgs, accompanied by this, the drain current also changes in the range of ΔId. Here, it has been known that the organic EL element exhibits a light emission intensity characteristic approximately proportional to the value of the current flowing in this element.

Accordingly, as a result of the state in which the value of Vgs changes influenced by the ripple component in response to timings of addressing as described above, a result that light emission intensities of respective EL elements in the light emitting display panel 1 differ for each scan line is produced. Thus, in the display panel, a problem that the display quality of an image is considerably deteriorated may occur. That is, for example, a fine striped pattern, phenomenon of flicker, or the like may occur.

In order to avoid such a problem, it can be considered that a regulator circuit for example as shown in FIG. 5 is adopted. That is, the regulator circuit shown in FIG. 5 is interposed between the output terminal of the DC-DC converter and the power source lines P1, . . . in the display panel 1. The regulator circuit shown in this FIG. 5 is composed of an NPN transistor Q2, an error amplifier constituted by an op amp OP1, and a reference voltage source Vref1. The emitter potential of the NPN transistor Q2 is supplied to the non-inverting input terminal of the op amp OP1, and the electrical potential of the reference voltage source Vref1 is supplied to the inverting input terminal of the op amp OP1.

With this structure, the ripple component generated in the emitter side of the transistor Q2 is outputted to the error amplifier constituted by the op amp OP1. Since the base potential of the transistor Q2 is changed by the output of the error amplifier, as a result, at the emitter side of the transistor Q2, that is, at a Vout side, an output voltage that the ripple component is almost removed can be obtained. However, in the regulator circuit, a power loss of (Vin−Vout)×Iout=P[W] always occurs. Accordingly, due to a problem that the continuous utilization time of a battery is drastically shortened, it is difficult to adopt such a device in the above-mentioned portable equipment under actual conditions.

Thereupon, the present applicant has already filed Japanese Patent Application No. 2004-34401 with respect to a light emitting display device in which a boost frequency in the DC-DC converter by the PWM method is synchronized with a scan signal (synchronized with a frequency that is n times the line frequency) so that for each scan line the same gate-to-source voltage Vgs is constantly supplied to the light emission drive transistor even when a ripple component by a switching operation is superimposed on an operational power source. Thus, a state in which light emitting intensities differ for each scan line can be prevented, and a problem that the display quality of an image is deteriorated, such as occurrence of a fine striped pattern or of a phenomenon of flicker in the display panel, can be effectively dissolved.

However, with the light emitting display device of the above-described structure, since the switching operation in the DC-DC converter is performed by the PWM method, for example, even in a state in which the number of lit pixels of the display is small so that the display is in a state of light load, the switching operation is always performed periodically in the converter. Thus, there is a problem that a useless power loss by the switching operation occurs so that the power utilization rate of a light load time is reduced.

SUMMARY OF THE INVENTION

The present invention is to further solve the above-described problems in the light emitting display device according to the prior application of the present applicant, and it is an object of the present invention to provide a light emitting display device and a drive control method thereof by which a problem that the display quality of an image is deteriorated for example by a ripple component generated in a power source circuit or the like represented by a DC-DC converter can be effectively resolved and by which the power utilization rate of a light load time can be improved.

A light emitting display device according to the present invention which has been developed to solve the above problems is, as described in a first aspect of the present invention, a light emitting display device equipped with a display panel constructed by arranging a large number of pixels which respectively include a light emitting element at respective intersection positions between a plurality of scan lines and a plurality of data lines, characterized in that the display panel is electrically connected to a circuit structuring section with a switching operation, that the switching operation in the circuit structuring section is synchronous with a scan selection operation for scan lines in the display panel, and that the frequency of the switching operation is able to changed.

A drive control method of a light emitting display device according to the present invention which has been developed to solve the above problems is, as described in a seventeenth aspect of the present invention, a drive control method of a light emitting display device equipped with a display panel constructed by arranging a large number of pixels which respectively include a light emitting element at respective intersection positions between a plurality of scan lines and a plurality of data lines, characterized in that the display panel is electrically connected to a circuit structuring section with a switching operation, that the switching operation in the circuit structuring section is synchronous with a scan selection operation for scan lines in the display, and that the frequency of the switching operation is controlled to be able to changed.

DESCRIPTION OF THE PREFERRED EMBODIMENTS

Figure 1:
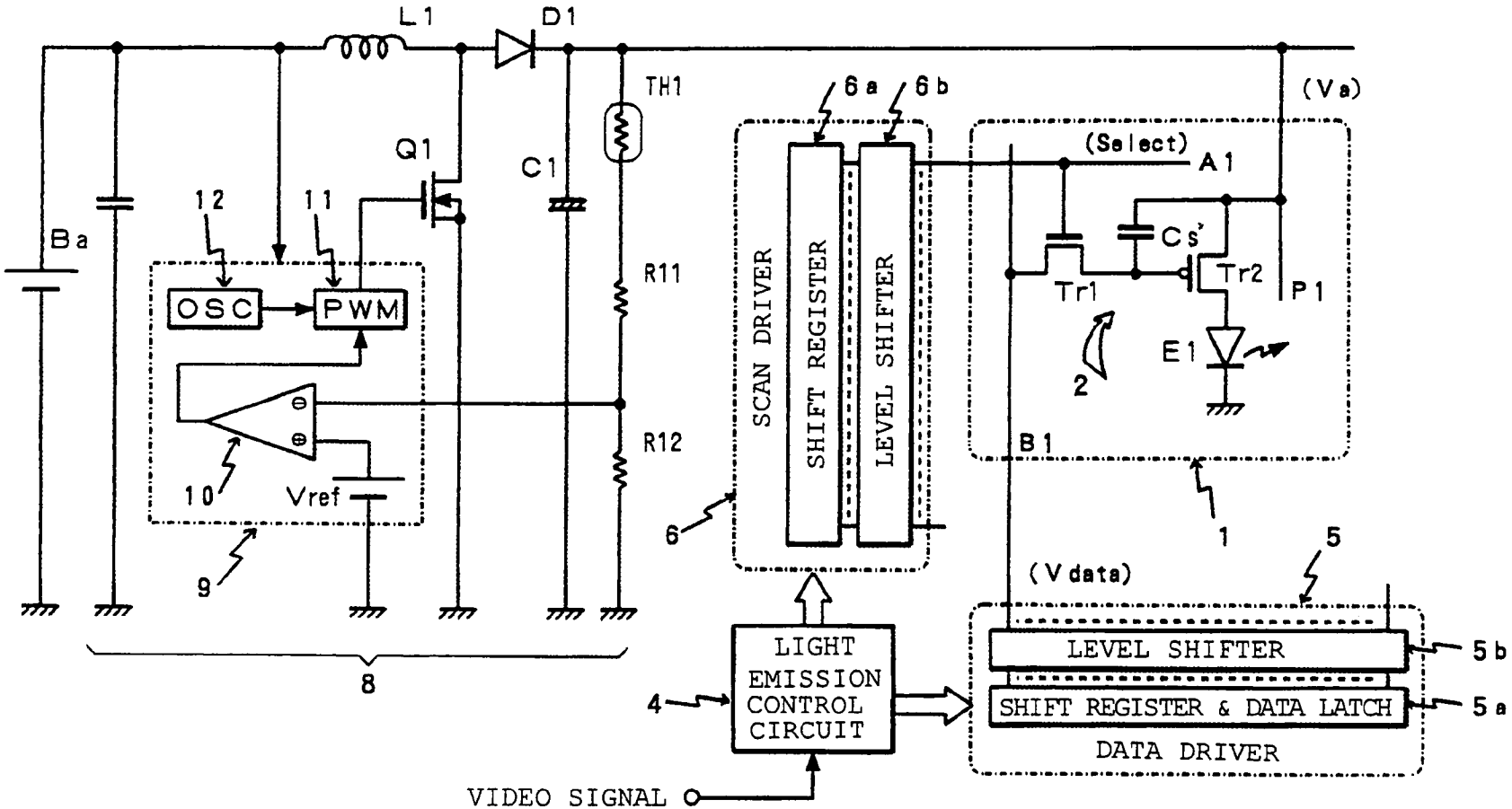
FIG. 1 is a circuit structure diagram showing one example of a circuit structure corresponding to one pixel in a conventional active matrix type display panel and a power source circuit or the like for light emission drive therefor.

A light emitting display device according to the present invention will be described below with reference to the embodiments shown in FIG. 6 and following drawings. In the respective drawings described below, parts performing the same functions as those of the respective parts already described are designated by the same reference numerals, and detailed description thereof will be omitted appropriately.

Figure 2:
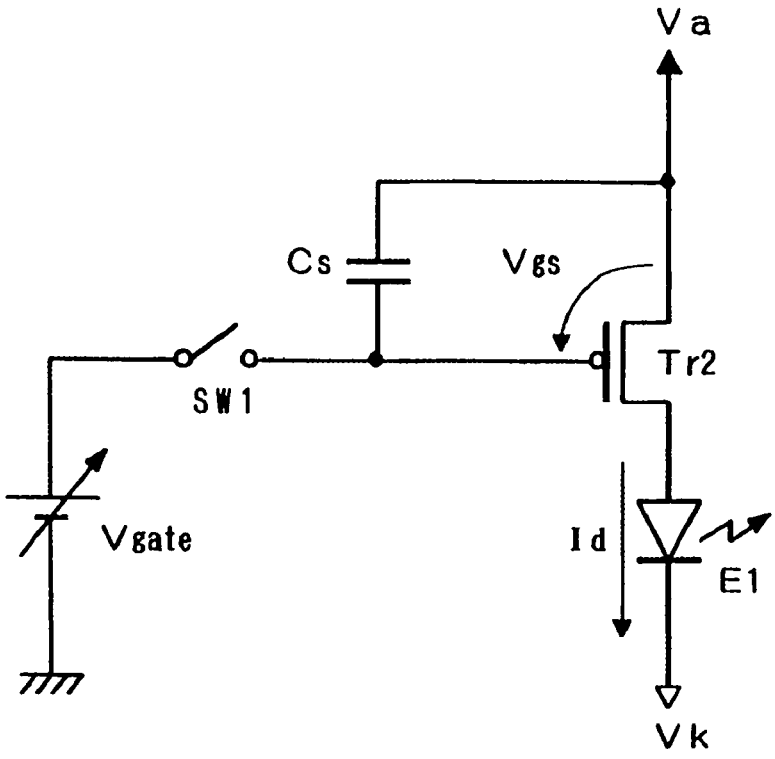
FIG. 2 is an equivalent circuit diagram of the pixel structure in the display panel shown in FIG. 1.
Figure 6:
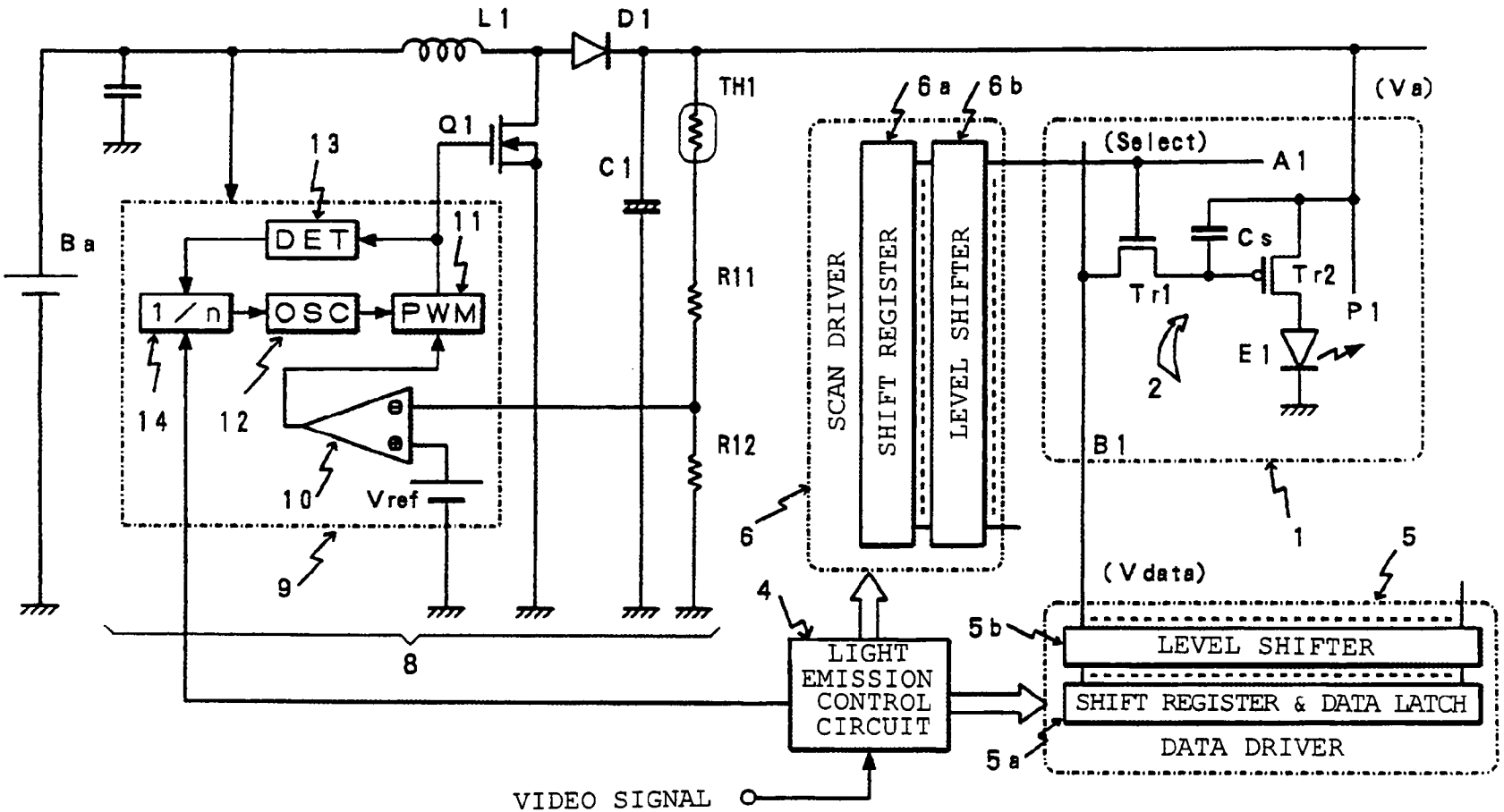
FIG. 6 is a circuit structure diagram showing a first embodiment in which the present invention is adopted for a pixel structure of a conductance control drive method.

First, FIG. 6 shows a first embodiment of the display device, and in this example, a display panel 1 having a pixel structure of a conductance control method shown in FIGS. 1 and 2 is employed. In this embodiment, the display panel 1 is constructed to be electrically connected to a circuit structuring section with a switching operation, that is, a DC-DC converter 8, and is constructed to receive supply of an operational power source Va from this DC-DC converter 8. This manner is the same as that of the example shown in FIG. 1 already described.

Meanwhile, the embodiment shown in this FIG. 6 is constructed such that the switching operation of PWM given to the DC-DC converter 8 is synchronized with a scan selection operation for scan lines in the display panel and further that the frequency of the switching operation is varied. That is, as shown in FIG. 6, a clock signal (scan shift clock) corresponding to a scan frequency (this is also referred to as a line frequency) given to the display panel 1 from a light emission control circuit 4 is supplied to a switching regulator 9 in the DC-DC converter 8.

The clock signal is supplied to a divider circuit 14, and the output obtained by frequency division in this divider circuit 14 is supplied to an oscillator 12. Thus, an oscillation output from the oscillator 12 generating the above-mentioned chopping wave for PWM is synchronous with the line frequency, so that a reference signal of a PWM wave added to the power FET Q1 in the DC-DC converter 8 is also synchronous with the line frequency.

Meanwhile, the PWM signal from the PWM circuit 11 is supplied to the gate of the power FET Q1 as a switching signal and also to a duty ratio detection circuit 13 provided as a load detection means. The duty ratio detection circuit 13 monitors the duty ratio of the PWM signal. When this duty ratio becomes a predetermined value or greater (when the load of the converter is heavy), the duty ratio detection circuit 13 operates to send a command for decreasing the division ratio of the divider circuit 14 to the divider circuit 14. Thus, while the oscillation output from the oscillator 12 is synchronous with the line frequency, switching is performed for example to make the output frequency thereof become doubled.

When the duty ratio of the PWM signal becomes a predetermined value or less (when the load of the converter is light), the duty ratio detection circuit 13 similarly operates to send a command for increasing the division ratio of the divider circuit 14 to the divider circuit 14. Thus, while the oscillation output from the oscillator 12 is synchronous with the line frequency, switching is performed for example to make the output frequency thereof become 1/n (where n is an integer).

By this operation, the PWM signal in the DC-DC converter 8 is controlled such that the frequency of the switching operation by the PWM method becomes small (cycle of the switching operation is prolonged) as the load becomes lighter. Accordingly, a useless power loss by the switching operation in the DC-DC converter can be reduced, so that the power utilization rate of a light load time can be improved.

Figure 7:
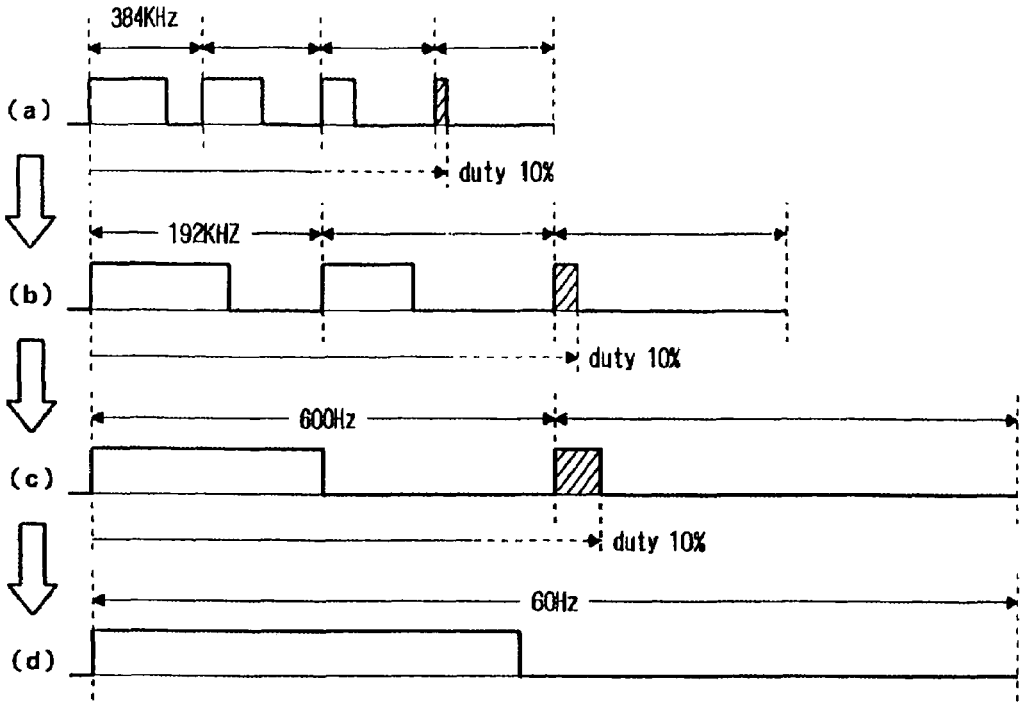
FIG. 7 is a timing diagram explaining operations of a case where the load of a switching converter becomes lighter in sequence in the structure shown in FIG. 6.
Figure 8:
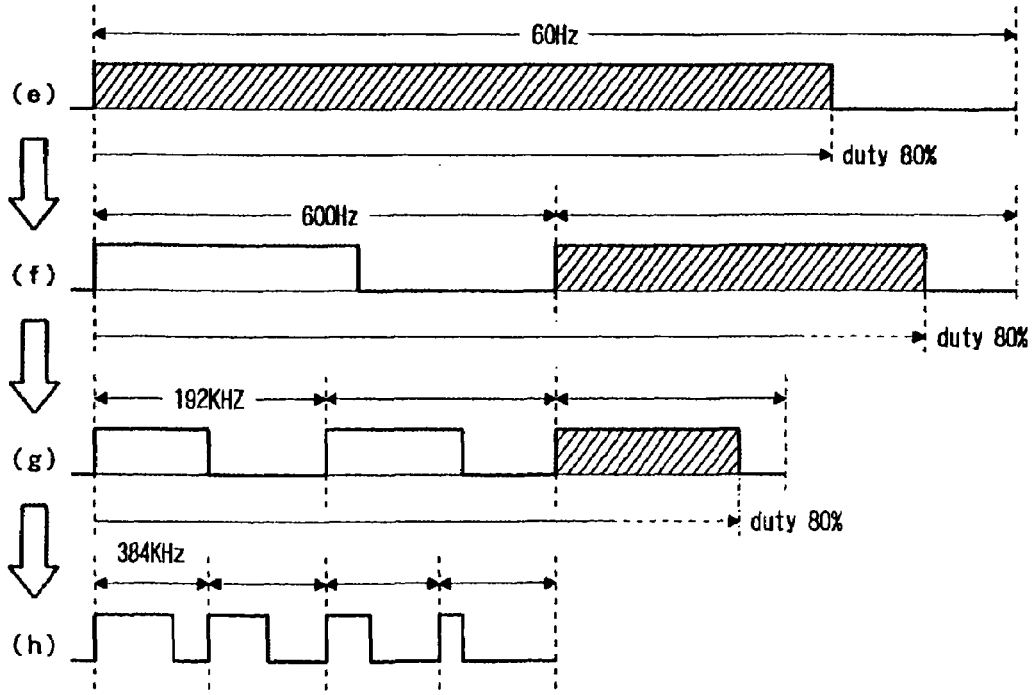
FIG. 8 is a timing diagram explaining operations of a case where the load of the same switching converter becomes heavier in sequence.

FIGS. 7 and 8 show an example of such operations, wherein (a) to (d) in FIG. 7 exemplify a state in which the load in the DC-DC converter 8 becomes gradually lighter, and (e) to (h) in FIG. 8 exemplify a state in which the load in the DC-DC converter 8 becomes gradually heavier.

Here, before the example of the operations shown in FIGS. 7 and 8 is explained, considering the relationship between the line frequency and the frequency of the switching operation given to the DC-DC converter 8 (this is also referred to as a boost frequency), such a relationship is as follows. First, where it is supposed that a panel of a QVGA (240 RGB×320 dots) size is employed as the display panel 1, and where a subframe gradation method in which gradation control is performed in 10 steps is adopted while the frame frequency is 60 Hz, one line frequency=frame frequency×the number of lines (scan lines)×the number of subframes (the number of gradations)=60×320×10=192 KHz 1 subframe frequency=frame frequency×subframe frequency (the number of gradations)=60×10=600 Hz.

According to the above-described calculations, it is desired that the boost frequency is set at a frequency which is synchronous with 192 KHz that is the line frequency, and that in the DC-DC converter, the maximum value of the boost frequency is set at 384 KHz that is double of 192 KHZ, considering current supply capacity. Thus, in the embodiment shown in FIG. 6, under the condition that a clock signal of 384 KHz that is two times as the line frequency has been supplied from the light emission control circuit 4 to the divider circuit 14, operations thereof will be described below.

An example of operations shown in FIGS. 7 and 8 will be described under the above-described condition. FIG. 7(*a*) shows an example of a switching operation by PWM in the case where the boost frequency has been set at 384 KHz that is in a state of a maximum value. In a state shown in this FIG. 7(*a*), the duty ratio detection circuit 13 is monitoring the duty ratio of the PWM signal and operates to send a command for increasing the division ratio of the divider circuit 14 to the divider circuit 14 in a case where this duty ratio becomes at a predetermined value or less (in this example, 10% or less as hatched).

Thus, while the oscillation output from the oscillator 12 is synchronous with the line frequency, switching is performed to make the output frequency thereof become ½ times, that is, n=2 in the divider circuit 14. As a result, the boost frequency of the PWM circuit 11 shown in FIG. 6 is set at 192 KHz, and the PWM signal by this setting is supplied to the gate of the power FET Q1. In this state, the detection circuit 13 monitors the duty ratio shown in FIG. 7(*b*), and in the case where this duty ratio further becomes 10% or less as hatched, the division ratio in the divider circuit 14 is switched to the next.

In order to switch the boost frequency to a next frequency which is lower than the line frequency (192 KHz), as shown in FIG. 7(*c*), the division ratio of the divider circuit 14 is set so as to be 600 Hz that is one subframe frequency. In this state, the detection circuit 13 monitors the duty ratio shown in FIG. 7(*c*), and in the case where this duty ratio further becomes 10% or less as hatched, the division ratio in the divider circuit 14 is newly set to be at a boost frequency of 60 Hz that is the same frequency as the frame frequency as shown in FIG. 7(*d*).

The above-mentioned boost frequency of 60 Hz is the minimum frequency which can be utilized in the present embodiment, and even in a case where the state of the load is lighter than this, the boost frequency shown in FIG. 7(*d*) is maintained, whereby a boost operation by PWM control is executed. In the case where the boost frequency of 60 Hz is made as described above, the cycle of the switching operation (boost cycle) is made extremely large, compared to the maximum boost frequency (384 KHz) already described, so that a useless power loss by the switching operation in the DC-DC converter can be reduced, whereby the power utilization rate of a light load time can be improved.

Meanwhile, (e) to (h) in FIG. 8 exemplify operations of a case where the load in the DC-DC converter becomes heavier from a lightest state. That is, as shown in FIG. 8(*e*), in the case where the duty ratio detection circuit 13 detects that the duty ratio has become a predetermined value or greater (in this example, 80% or greater as hatched) in a state in which the PWM signal is the boost frequency of 60 Hz, the duty ratio detection circuit 13 operates to send a command for decreasing the division ratio of the divider circuit 14 to the divider circuit 14.

Thus, as shown in FIG. 8(*f*), the division ratio of the divider circuit 14 is set so as to be 600 Hz that is one subframe frequency. In this state, in a case where the duty ratio detection circuit 13 monitors the duty ratio of the PWM signal to detect that this duty ratio further becomes 80% or greater as hatched, as shown in FIG. 8(*g*), the division ratio of the divider circuit 14 is set to be 192 KHz that is a line frequency.

Further, in this state, in a case where the duty ratio detection circuit 13 detects that the duty ratio of the PWM signal becomes 80% or greater as hatched, as shown in FIG. 8(*h*), the division ratio of the divider circuit 14 is set to be 384 KHz that is the maximum boost frequency. In this way, in response to the magnitude of the load applied to the DC-DC converter, the operations of FIGS. 7(*a*)-(*d*) and FIGS. 8(*e*)-(*h*) are repeated.

In the example shown in FIG. 8, in the case where operation shifts to (e) to (f), setting to the frequency of one subframe may not be performed, and for example setting to the line frequency/2 or the line frequency may be performed. Further, even in the case where operation shifts to (f) to (g), setting to the line frequency may not be performed, and for example setting to the line frequency/2 may be performed. That is, aspects of these frequency shifts may be selected appropriately while they are designed.

Figure 9:
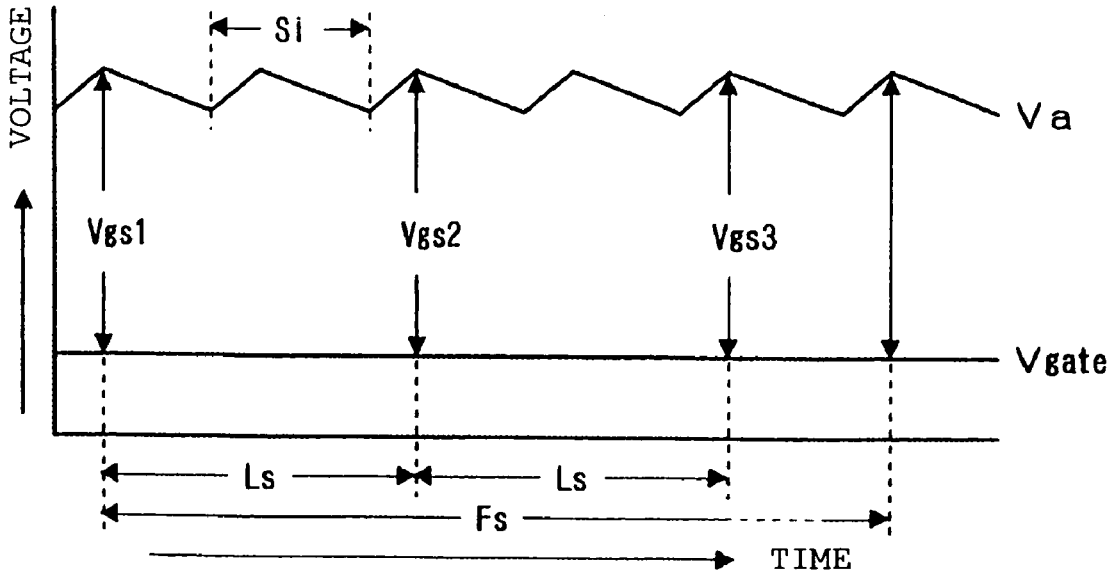
FIG. 9 is a signal waveform explaining a drive voltage which is added to the source electrode of a drive transistor for each scan line in the structure shown in FIG. 6.

FIG. 9 is a timing diagram explaining operations of a case where the boost operation in the DC-DC converter is synchronized with the scan selection operation for scan lines in the display panel 1. The timing diagram shown in this FIG. 9 is similar to that of shown in FIG. 3 already described, and Va designates a drive voltage on which a ripple component corresponding to a boost cycle S1 produced from the DC-DC converter is superimposed. Vgate designates a gate voltage which is based on a video signal supplied to the gate of a drive transistor Tr2 during an addressing time (data write time). Further, Ls denotes one scan (line) period in the display panel, and Fs shows one frame period.

The example shown in FIG. 9 exemplifies the case of the maximum boost frequency (384 KHz) in this embodiment, as shown in FIG. 7(*a*) and FIG. 8(*h*), in which the relationship is set such that the line cycle Ls is two times as the boost cycle S1, in other words, that the boost frequency is two times as the line frequency. In the case of this example, for example, data based on a gate-to-source voltage shown as Vgs1 is written in capacitors Cs of respective pixels corresponding to a first scan line, and data based on gate-to-source voltages shown as Vgs2, Vgs3 are written in capacitors Cs of respective pixels corresponding to second and third scan lines, respectively.

Figure 3:
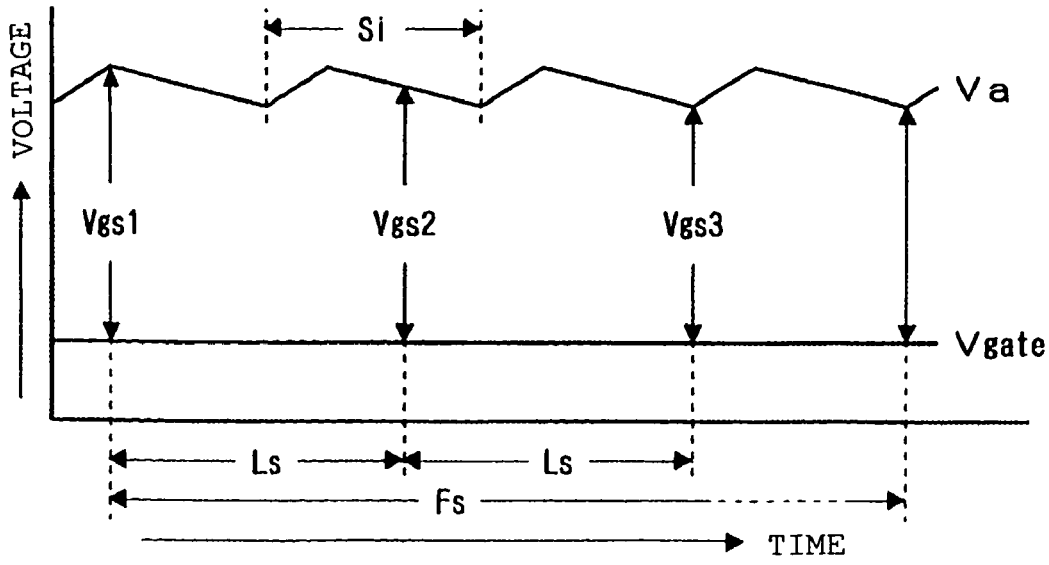
FIG. 3 is a signal waveform explaining a drive voltage which is added to the source electrode of a light emission drive transistor in the equivalent circuit diagram shown in FIG. 2.
Figure 4:
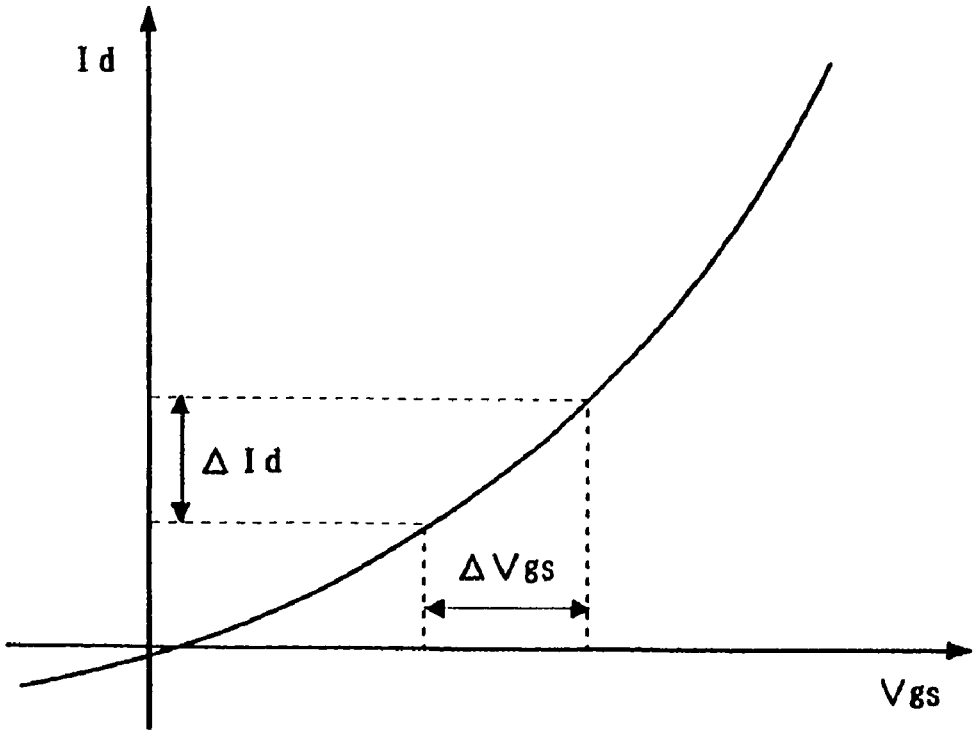
FIG. 4 is a Vgs/Id characteristic graph of a TFT represented by the light emission drive transistor shown in FIG. 2.
Figure 5:
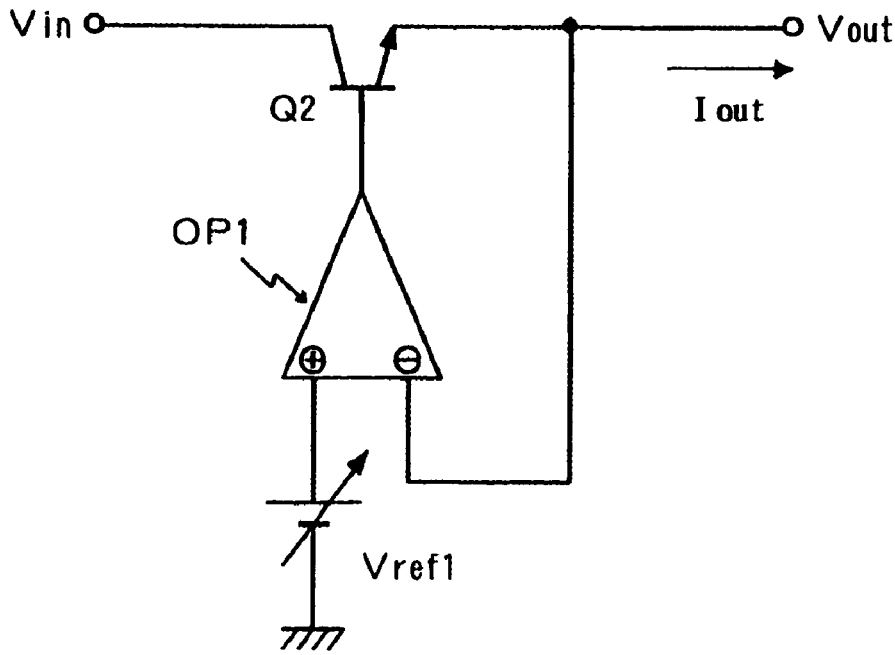
FIG. 5 is a circuit structure diagram showing one example which is to dissolve trouble in the conventional structure shown in FIG. 1.

As can be understood with reference to FIG. 9, the timing of the data write time for each scan line is synchronous with the phase of the ripple component superimposed on the drive voltage Va. Accordingly, even when the ripple component by the switching operation of the DC-DC converter has been superimposed on the drive voltage Va, the same gate-to-source voltage Vgs is constantly supplied to the light emission drive transistors Tr2 for each scan line, so that the problem that the state in which light emission intensities differ for each scan line as in the conventional structure shown in FIG. 3 is brought about can be resolved. Thus, in a light emission drive operation of a display panel in which the above-described EL elements having a current-dependent type light emission intensity characteristic are employed as pixels, the display quality of an image can be effectively prevented from being deteriorated influenced by a power source ripple.

Even in the cases of FIG. 7(*b*) and FIG. 8(*g*) where the boost cycle S1 and the line cycle Ls are made equal (boost frequency=line frequency), since the timing of the data write time for each scan line is synchronous with the phase of the ripple component superimposed on the drive voltage Va, the gate-to-source voltage written in the capacitors Cs of respective pixels corresponding to each scan line becomes constant without being influenced by the power source ripple, and operations and effects similar to those described above can be obtained.

As shown in FIGS. 7(*c*), (*d*) and FIGS. 8(*e*), (*f*), in the cases where the boost frequency is set at the subframe frequency (600 Hz) or the frame frequency (60 Hz), in the capacitors Cs of respective pixels corresponding to the first scan line to the final 320th scan line, electrical potentials (Vgs) whose values are slightly different from one another depending on a ripple change amount by one switching operation are written regularly in sequence. Accordingly, a state in which gate-to-source voltages (Vgs) written in capacitors Cs of respective pixels corresponding to adjacent scan lines change irregularly and extremely as shown in FIG. 3 can be prevented from occurring, so that the display quality of an image can be effectively prevented from being deteriorated influenced by the power source ripple, similarly to the above.

Figure 10:
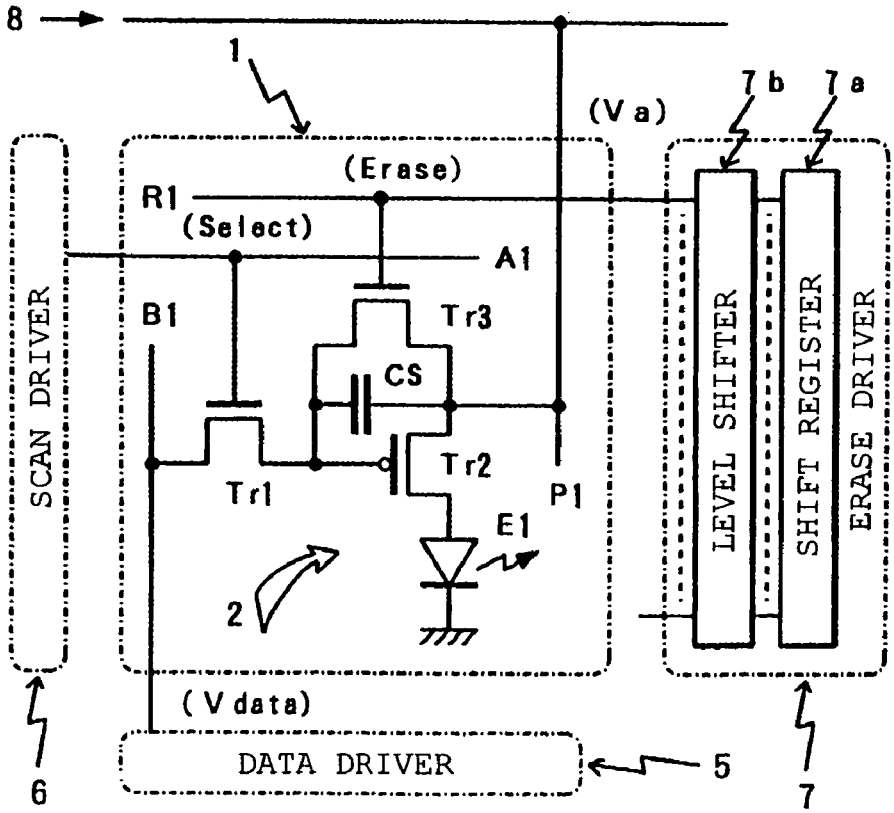
FIG. 10 is a circuit structure diagram showing a second embodiment in which the present invention is adopted for a pixel structure of an SES drive method which realizes time division gradation expression.

FIG. 10 shows a second embodiment in which the present invention is utilized, and this example shows a pixel structure composed of 3 TFTs in which a lighting drive method called a simultaneous erasing scan (SES) method realizing time division gradation expression is adopted. Although FIG. 10 shows a circuit structure of one display pixel representatively for convenience of illustration, a large number of these circuit structures are arranged in a matrix pattern on the display panel 1 shown in FIG. 6.

The circuit structure of the pixel shown in FIG. 10 is equipped with an erase transistor Tr3 by a TFT in addition to the pixel structure of the lighting drive method called the conductance control method already described with reference to FIGS. 1 and 6. In FIG. 10, parts corresponding to the respective parts described with reference to FIGS. 1 and 6 are designated by the same reference characters, and the block structures of the data driver 5 and the scan driver 6 shown in FIGS. 1 and 6 are omitted.

As shown in FIG. 10, a source and a drain of the erase transistor Tr3 are connected to the source side and the gate side of the light emission drive transistor Tr2, respectively. That is, the source and drain of the erase transistor Tr3 are connected to both ends of the capacitor Cs, respectively, and an erase signal Erase is supplied from an erase driver 7 via an erase signal line R1 arranged in the display panel 1.

This erase driver 7 operates to supply the erase signal Erase which turns the erase transistor Tr3 on from the erase driver 7, in the middle of a light emission period of an EL element E1 constituting each pixel, for example, in the middle of one frame period. Thus, electrical charges charged in the capacitor Cs are erased (discharged). In other words, by controlling output timing of a gate ON voltage (erase signal Erase) supplied from the erase driver 7 for each one frame period or each one subframe period, the light emission period of the EL element E1 is controlled, and thus multi-gradation expression can be realized.

The erase driver 7 realizing the multi-gradation expression is provided with a shift register 7*a*, and to this shift register 7*a*, a shift clock and an erase data signal are supplied from the light emission control circuit 4 shown in FIG. 6. The shift clock supplied to this shift register 7*a* is synchronized with the scan shift clock supplied to the shift register 6*a* of the scan driver 6 described with reference to FIG. 1. Accordingly, a shift output from the shift register 7*a* is supplied to the erase signal lines R1, . . . which correspond to the respective scan lines selected for scanning by the scan driver 6.

At this time, the erase data signal by the form of PWM (pulse width modulation) has been superimposed on the shift output from the shift register 7*a*. That is, serial erase data signals supplied from the light emission control circuit 4 shown in FIG. 6 to the shift register 7*a* are processed by parallel conversion for each erase signal line R1, . . . by the shift register 7*a*, and this is converted to a predetermined level by a level shifter 7*b* so as to be supplied to the gate of the erase transistor Tr3 corresponding to a pixel in the light emitting state.

In the above-described structure, by the gate ON operation of the erase transistor Tr3, electrical charges accumulated in the charge-retaining capacitor Cs are discharged by a Vgs/Id characteristic (gate-to-source voltage vs. drain current characteristic) of the erase transistor Tr3. In this case, the drive voltage Va containing the ripple component produced from the DC-DC converter is applied to the source of the erase transistor Tr3, and a constant gate voltage based on the erase data signal is supplied to the gate of the erase transistor Tr3.

Therefore, with the structure of SES shown in FIG. 10, by the level of the ripple component superimposed on the operational power source Va during the gate ON time of the erase transistor Tr3, a discharge current for erasing electrical charges of the charge-retaining capacitor Cs changes for each line. In the case where this discharge current changes for each line, the lights-out timing of each pixel based on gradation expression changes for each line, resulting in substantially different light emission intensities for each line by the ripple component.

Thus, by the above-described operation, even during the erase operating time of SES shown in FIG. 10, similarly to the pixel structure of the conductance control method already described, a similar problem that the display quality of an image is deteriorated may occur. That is, for example, a fine striped pattern, phenomenon of flicker, or the like may occur in the display panel.

In order to solve such a problem, even in the structure shown in FIG. 10, as the shift clock signal supplied from the light emission control circuit 4 to the shift register 7*a* of the erase driver 7, a clock signal of 192 KHz obtained by ½ of frequency division with respect to the clock signal of already exemplified 384 KHz which is synchronous with the boost operation in the DC-DC converter 8 shown in FIG. 6 is utilized.

Thus, the switching operation in the DC-DC converter 8 and the erase start operation of the erase transistor are performed based on a common clock signal, and as a result, electrical potentials of the ripple component at the erase operating time of the erase transistor Tr3 can be allowed to coincide with each other for each scan line. This operation is similar to that described with reference to FIG. 9.

Therefore, even when the ripple component by the switching operation of the DC-DC converter has been superimposed on the drive voltage Va, Vgs of the erase operating time of the erase transistor Tr3 can be allowed to be a constant value, and the discharge current of electrical charges of the charge-retaining capacitor Cs varies for each line. As a result, a problem that a substantial light emission intensity varies for each line can be resolved.

Figure 11:
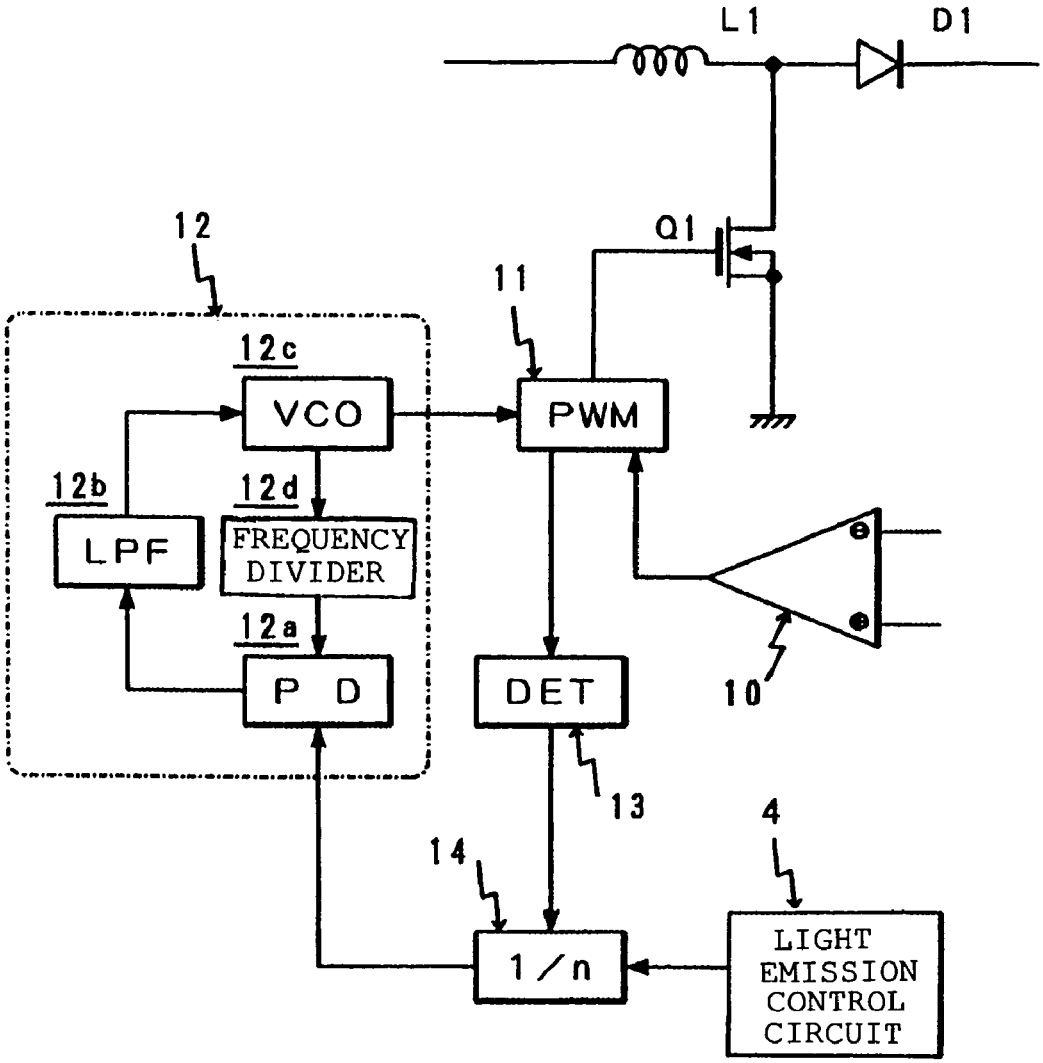
FIG. 11 is a circuit structure diagram showing a third embodiment according to the present invention in which an improvement is provided in a regulator circuit of a switching converter.

Next, FIG. 11 shows a third embodiment according to the present invention in which an improvement is provided in a switching regulator circuit in the DC-DC converter. In FIG. 11, parts corresponding to the respective parts of the DC-DC converter 8 described with reference to FIGS. 1 and 6 are designated by the same reference characters. The oscillator 12 in the DC-DC converter shown in FIG. 1 is composed of a PLL (phase locked loop) circuit.

To the PLL circuit constituting the oscillator 12, a signal via the frequency divider 14 which divides the clock signal of 384 KHz produced from the light emission control circuit 4 is supplied. The frequency divider 14 is constructed such that, similarly to the structure shown in FIG. 6, a command signal from the duty ratio detection circuit 13 which is provided as a load detection means is inputted thereto so that the division ratio is varied. That is, the duty ratio detection circuit 13 shown in this FIG. 11 also, similarly to the duty ratio detection circuit 13 shown in FIG. 6, operates to monitor the duty ratio of the switching signal from the PWM circuit 11 and vary the division ratio of the frequency divider 14 in accordance with a predetermined program in a case where this duty ratio becomes a predetermined value or greater (the duty ratio is 80% or greater) or a predetermined value or less (the duty ratio is 10% or less).

The PLL circuit constituting the oscillator 12 is composed of a phase detector (PD) 12*a* which compares the phase of the clock signal produced from the frequency divider 14 with the phase of the frequency-dividing output from a frequency divider 12*d* constituting a PLL circuit to output an error signal corresponding to the phase difference, a low pass filter (LPF) 12*b* which receives the output from the phase detector 12*a* to extract a DC component, a voltage control oscillator (VCO) 12*c* whose oscillation frequency is determined by the DC component obtained by this low pass filter 12*b*, and a frequency divider 12*d* which divides the frequency of the output of the voltage control oscillator 12*c* to supply the divided frequency to the phase detector 12*a*.

Accordingly, as shown in FIG. 11, by constructing the oscillator 12 in the DC-DC converter 8 by the PLL circuit, an oscillation output synchronous with the clock signal produced from the frequency divider 14 can be obtained from the voltage control oscillator 12*c*, and the PWM circuit 11, utilizing this, can generate a switching signal by an ideal boost frequency in accordance with the load condition of the DC-DC converter.

By appropriately setting the division ratio of the frequency divider 12*d* constituting the PLL circuit, the PLL circuit can be utilized as a multiplier, and even when the clock signal given to this PLL circuit has relatively low frequency, a reference signal for generating the maximum boost frequency (384 KHz) can be easily obtained from the voltage control oscillator 12*c*. In this embodiment, although the maximum boost frequency is 384 KHz, by setting of the frequency divider 12*d* in the PLL circuit, a boost frequency of 768 KHz further doubled can be obtained.

Figure 12:
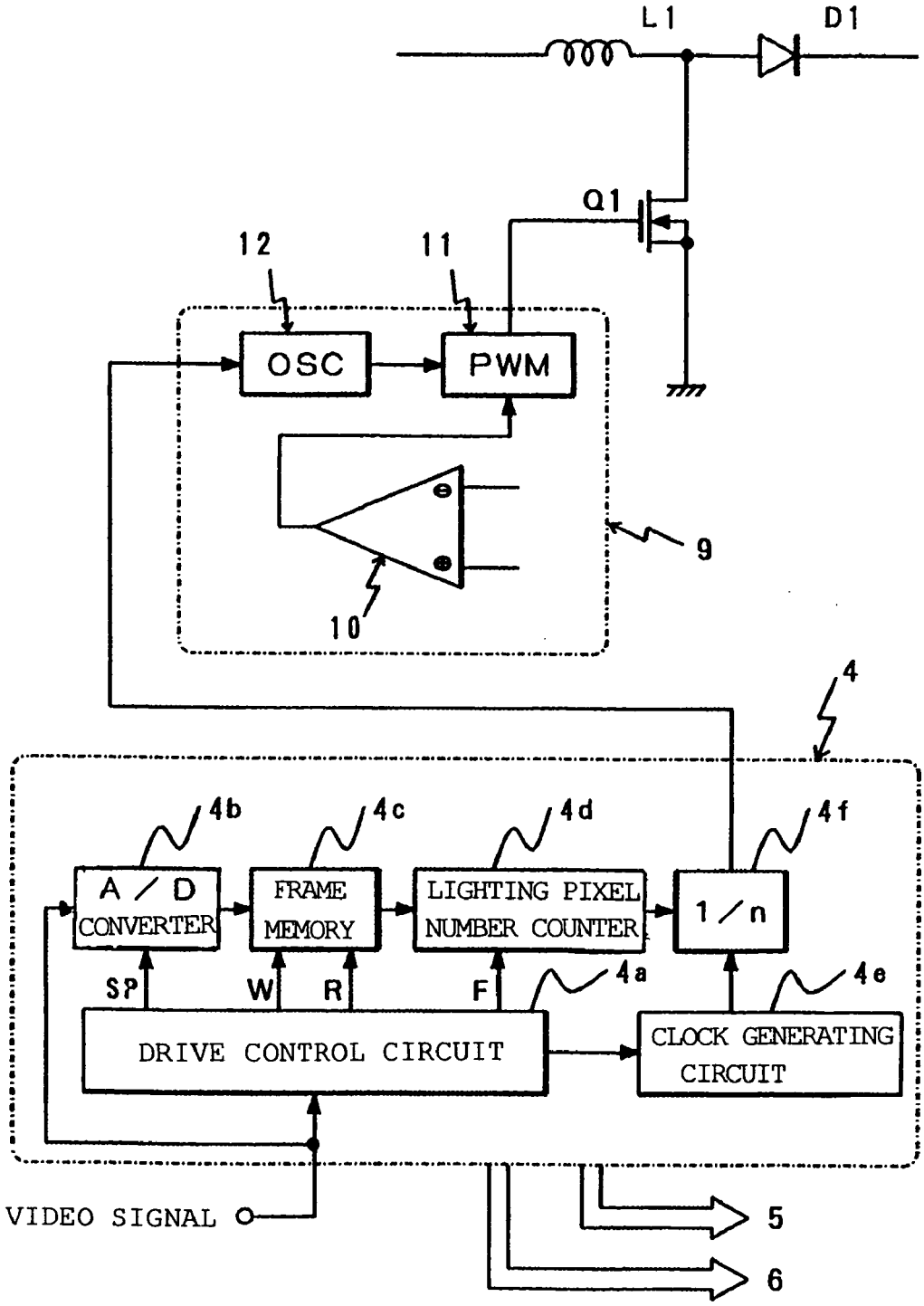
FIG. 12 is a circuit structure diagram showing a fourth embodiment according to the present invention in which an improvement is provided in a light emission control circuit.

FIG. 12 shows a fourth embodiment according to the present invention in which another means for detecting the load condition in the DC-DC converter is provided. In the structure shown in this FIG. 12, the load condition in the DC-DC converter is detected by the lighting ratio of pixels in a unit frame period or a subframe period of a display panel.

Reference numeral 4 in FIG. 12 denotes the light emission control circuit already described, and in this embodiment, a frequency divider 4*f* is disposed in the light emission control circuit 4 so as to divide the frequency of the clock signal given to a switching regulator 9 in accordance with the load condition of the DC-DC converter. That is, the frequency divider 4*f* disposed in this light emission control circuit 4 carries out the same function as that of the frequency divider 14 already described with reference to FIGS. 6 and 11.

To the light emission control circuit 4, a video signal to be displayed in the display panel 1 is supplied as already described. This video signal is inputted to a drive control circuit 4*a* and an analogue/digital (A/D) converter 4*b* in the light emission control circuit 4. Thus, the drive control circuit 4*a* generates a sampling signal SP for the A/D converter 4*b*, a write signal W and a read signal R for a frame memory 4*c*, and a count command signal F for a lighting pixel number counter 4*d*, based on horizontal and vertical synchronization signals in the video signal.

The A/D converter 4*b* operates to sample the inputted video signal based on the sampling signal SP supplied from the drive control circuit 4*a*, to convert this to corresponding pixel data for each one pixel, and to supply this to the frame memory 4*c*. The frame memory 4*c* operates to sequentially write respective pixel data supplied from the A/D converter 4*b* in the frame memory 4*c* by the write signal W supplied from the drive control circuit 4*a*.

By such a write operation, after writing pixel data of one screen in the display panel is completed, the frame memory 4*c* operates to sequentially supply serial pixel data which is read out, for example, for each row from a first row to nth row, to a data latch circuit 5*a* in the data driver 5 shown in FIG. 6 by the read signal R supplied from the drive control circuit 4*a*.

At this time, a clock generating circuit 4*e* generates a clock signal based on the horizontal and vertical synchronization signals in the video signal so that this clock signal is supplied to the frequency divider 4*f*. Meanwhile, a shift clock signal, a start signal, a latch signal, and the like supplied to the data driver 5 based on the clock signal are generated, and also a scan clock signal, a scan start signal, and the like supplied to the scan driver 6 are generated.

To the lighting pixel number counter 4*d* arranged in the light emission control circuit 4, the count command signal F is supplied for each the unit frame period, that is, for each one frame period or one subframe period, from the drive control circuit 4*a*, and thus the lighting pixel number in pixel data of one screen written in the frame memory 4*c* is counted. Accordingly, by the counter 4*d*, the lighting ratio of pixels in the display panel 1 can be obtained each time counting is performed. This pixel lighting ratio can be recognized as the degree of the load in the DC-DC converter, and thus the counter 4*d* functions as a load detection means of the converter.

A command signal for varying the division ratio in accordance with the degree of the load is supplied from the counter 4*d* to the frequency divider 4*f*, and control is performed such that the division ratio of the frequency divider 4*f* becomes smaller when the load is heavy while the division ratio of the frequency divider 4*f* becomes greater when the load is light. An output pulse by this frequency divider 4*f* is supplied to the oscillator 12 in a switching regulator circuit 9 shown in FIG. 12.

Thus, similarly to the operations described with reference to FIGS. 7 and 8, the switching frequency of the PWM wave is varied in accordance with the magnitude of the load applied to the DC-DC converter. In a case where the load applied to the converter is light, the cycle (boost cycle) of the switching operation in the converter is made greater, and a useless power loss by the switching operation in the DC-DC converter can be reduced, whereby the power utilization rate of a light load time can be improved.

The embodiments described above exemplifies a case wherein while a QVGA size of panel is employed as a display panel, a subframe gradation method in which gradation control is performed for example at 10 steps is adopted, and 192 KHz that is one line frequency of this time is a basis of the boost frequency (frequency of the switching operation). That is, in accordance with the load, respective boost frequency is switched and set to a frequency synchronous with 192 KHz that is one line frequency.

However, the present invention can also be applied to a structure in which the subframe gradation method is not adopted as described above. In the case where the subframe gradation method is not adopted, as a basis of the boost frequency, it is desired to employ a switching operation frequency synchronous with a frequency that is integer times as large as (frame frequency given to a display panel)×(scan line number of the display panel), that is, integer times as large as 60×320=19.2 KHz. Accordingly, in this case, in accordance with the load, respective boost frequency is switched and set to a frequency synchronous with a frequency that is integer times as large as 19.2 KHz.

Although organic EL elements are employed as the light emitting element in the respective embodiments described above, as the light emitting element another light emitting element whose light emission intensity depends on the drive current may be employed. The structures of each pixel described above exemplify representative ones, and the present invention may also be utilized in a light emitting display device employing a pixel circuit structure such as for example of a current mirror drive method, a current programming drive method, a voltage programming drive method, a threshold voltage compensation method, or the like other than the above-described pixel structures.

What is claimed is:

1. A light emitting display device equipped with a display panel constructed by arranging a large number of pixels which respectively include a light emitting element at respective intersection positions between a plurality of scan lines and a plurality of data lines, characterized in that the display panel is electrically connected to a DC-DC converter, that the switching operation of PWM in the DC-DC converter is synchronized with a scan selection operation for scan lines in the display, and that the frequency of the switching operation of PWM is able to changed.

2. The light emitting display device according to claim 1, characterized in that an operation in which the frequency of the switching operation of PWM in the DC-DC converter is set at a frequency that is integer times as large as (frame frequency given to the display panel)×(scan line number of the display panel) is executed.

3. The light emitting display device according to claim 1, characterized in that an operation in which the frequency of the switching operation of PWM in the DC-DC converter is set at a frequency that is integer times as large as (frame frequency given to the display panel)×(scan line number of the display panel)×(subframe number of lighting drive in the display panel) is executed.

4. The light emitting display device according to claim 1, characterized in that an operation in which the frequency of the switching operation of PWM in the DC-DC converter is set at a frequency that is (frame frequency given to the display panel)×(subframe number of lighting drive in the display panel) is executed.

5. The light emitting display device according to claim 1, characterized in that an operation in which the frequency of the switching operation of PWM in the DC-DC converter is set at a frame frequency given to the display panel is executed.

6. The light emitting display device according to claim 1, characterized in that the switching operation of PWM in the DC-DC converter and the scan selection operation in the display panel are performed based on a common clock signal.

7. The light emitting display device according to claim 6, characterized in that an erase transistor which can erase electrical charges in the charge-retaining capacitor is further provided for each pixel, and that the switching operation of PWM in the DC-DC converter and an erase start operation of the erase transistor are performed based on a common clock signal.

8. The light emitting display device according to claim 1, characterized in that the frequency of the switching operation of PWM is controlled to be high when a load in the DC-DC converter is heavy, and that the frequency of the switching operation of PWM is controlled to be low when the load is light.

9. The light emitting display device according to claim 8, characterized in that said switching operation by PWM is controlled by a PWM signal outputted from a switching regulator circuit, and a condition of said load in said DC-DC converter is detected by a duty ratio detection circuit for monitoring a duty ratio of said PWM signal.

10. The light emitting display device according to claim 8, characterized in that the load in the DC-DC converter is found by a lighting ratio of pixels in a unit frame or subframe period of the display panel.

11. The light emitting display device according to claim 8, characterized in that a reference signal for executing the switching operation by the PWM method is obtained by an output of a voltage control oscillator of a PLL circuit whose phase is synchronous with a clock signal for executing the scan selection operation in the display panel.

12. A drive control method of a light emitting display device equipped with a display panel constructed by arranging a large number of pixels which respectively include a light emitting element at respective intersection positions between a plurality of scan lines and a plurality of data lines, characterized in that the display panel is electrically connected to a DC-DC converter, that the switching operation of PWM in the DC-DC converter is synchronized with a scan selection operation for scan lines in the display, and that the frequency of the switching operation of PWM is controlled to be able to changed.

13. The drive control method of the light emitting display device according to claim 12, characterized in that the frequency of the switching operation of PWM is controlled to be high when a load in the DC-DC converter is heavy, and that the frequency of the switching operation of PWM is controlled to be low when the load is light.

14. The light emitting display device according to claim 9, characterized in that a reference signal for executing the switching operation by the PWM method is obtained by an output of a voltage control oscillator of a PLL circuit whose phase is synchronous with a clock signal for executing the scan selection operation in the display panel.

15. The light emitting display device according to claim 10, characterized in that a reference signal for executing the switching operation by the PWM method is obtained by an output of a voltage control oscillator of a PLL circuit whose phase is synchronous with a clock signal for executing the scan selection operation in the display panel.

* * * * *